US012439958B2

(12) United States Patent
Jung et al.

(10) Patent No.: US 12,439,958 B2
(45) Date of Patent: Oct. 14, 2025

(54) AEROSOL GENERATING ARTICLE AND AEROSOL GENERATING SYSTEM COMPRISING THE SAME

(71) Applicant: KT&G CORPORATION, Daejeon (KR)

(72) Inventors: Sun Hwan Jung, Daejeon (KR); Chan Min Kwon, Daejeon (KR); Tae Kyung Lee, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 33 days.

(21) Appl. No.: 17/761,406

(22) PCT Filed: Nov. 9, 2021

(86) PCT No.: PCT/KR2021/016259
§ 371 (c)(1),
(2) Date: May 19, 2022

(87) PCT Pub. No.: WO2022/103127
PCT Pub. Date: May 19, 2022

(65) Prior Publication Data

US 2024/0041099 A1 Feb. 8, 2024

(30) Foreign Application Priority Data

Nov. 10, 2020 (KR) ..... 10-2020-0149591

(51) Int. Cl.
*A24D 1/20* (2020.01)
*A24D 1/00* (2020.01)
(Continued)

(52) U.S. Cl.
CPC ..... *A24D 1/20* (2020.01); *A24D 1/002* (2013.01); *A24D 1/045* (2013.01); *A24D 3/04* (2013.01);
(Continued)

(58) Field of Classification Search
CPC . A24D 1/20; A24D 3/04; A24D 3/166; A24D 3/17; A24C 5/01; A24F 40/46
(Continued)

(56) References Cited

U.S. PATENT DOCUMENTS 4,540,005 A * 9/1985 Cantrell ..... A24D 3/043 131/339
5,388,594 A * 2/1995 Counts ..... A24F 40/485 131/194
(Continued)

FOREIGN PATENT DOCUMENTS

CN 104939314 A 9/2015
CN 110089776 A 8/2019
(Continued)

OTHER PUBLICATIONS

International Search Report for PCT/KR2021/016259 dated, Feb. 15, 2022 (PCT/ISA/210).
(Continued)

*Primary Examiner* — Philip Y Louie
*Assistant Examiner* — Yana B Krinker
(74) *Attorney, Agent, or Firm* — Sughrue Mion, PLLC

(57) ABSTRACT

An aerosol generating article includes: a first segment impregnated with a first liquid composition; a second segment impregnated with a second liquid composition that is different from the first liquid composition; a cooling portion configured to allow an aerosol generated in the first segment or the second segment, to pass therethrough and cool the aerosol; and a filter portion having a hollow through which the aerosol that passed through the cooling portion flows.

10 Claims, 7 Drawing Sheets

(51) Int. Cl.

| | |
|---|---|
| ***A24D 1/04*** | (2006.01) |
| ***A24D 3/04*** | (2006.01) |
| ***A24D 3/17*** | (2020.01) |
| ***A24F 40/10*** | (2020.01) |
| ***A24F 40/46*** | (2020.01) |

(52) U.S. Cl.
CPC ..... *A24D 3/17* (2020.01); *A24F 40/10* (2020.01); *A24F 40/46* (2020.01)

(58) Field of Classification Search
USPC ..... 131/202, 331–346
See application file for complete search history.

(56) References Cited

U.S. PATENT DOCUMENTS

| | | | | |
|---|---|---|---|---|
| 7,647,932 | B2 | 1/2010 | Cantrell et al. | |
| 2008/0138398 | A1* | 6/2008 | Gonda | A61K 9/0075 514/343 |
| 2011/0186063 | A1* | 8/2011 | Fiebelkorn | A24D 3/045 131/344 |
| 2020/0163380 | A1 | 5/2020 | Lee et al. | |
| 2020/0352220 | A1 | 11/2020 | Cheong et al. | |
| 2021/0100281 | A1 | 4/2021 | Abi Aoun et al. | |
| 2021/0259303 | A1 | 8/2021 | Hwang et al. | |
| 2021/0267266 | A1 | 9/2021 | Park et al. | |

FOREIGN PATENT DOCUMENTS

| | | | | |
|---|---|---|---|---|
| GB | 2118424 | A | 11/1983 | |
| JP | 51-16520 | B1 | 5/1976 | |
| JP | 2009-502194 | A | 1/2009 | |
| JP | 2011-528900 | A | 12/2011 | |
| KR | 10-2015-0129683 | A | 11/2015 | |
| KR | 10-2019-0013716 | A | 2/2019 | |
| KR | 10-2019-0038301 | A | 4/2019 | |
| KR | 10-2020-0048811 | A | 5/2020 | |
| KR | 10-2020-0061130 | A | 6/2020 | |
| KR | 10-2020-0083570 | A | 7/2020 | |
| KR | 10-2020-0126343 | A | 11/2020 | |
| WO | 2010/010397 | A1 | 1/2010 | |
| WO | 2014/140320 | A1 | 9/2014 | |
| WO | 2017/207586 | A1 | 12/2017 | |
| WO | 2018/190603 | A1 | 10/2018 | |
| WO | WO-2019110747 | A1 * | 6/2019 | A24B 15/14 |
| WO | 2019/170455 | A1 | 9/2019 | |
| WO | 2020/009415 | A1 | 1/2020 | |
| WO | 2020/105940 | A1 | 5/2020 | |
| WO | WO-2020089067 | A1 * | 5/2020 | A24D 1/002 |
| WO | 2020/207733 | A1 | 10/2020 | |

OTHER PUBLICATIONS

Japanese Office Action dated Mar. 14, 2023, in Application No. 2022-514471.

Japanese Office Action issued Jul. 4, 2023 in Application No. 2022-514471.

Korean Office Action dated Nov. 7, 2022 in Korean Application No. 10-2020-0149591.

Extended European Search Report dated Nov. 11, 2022 in European Application No. 21870480.7.

* cited by examiner

AEROSOL GENERATING ARTICLE AND AEROSOL GENERATING SYSTEM COMPRISING THE SAME

CROSS REFERENCE TO RELATED APPLICATIONS

This application is a National Stage of International Application No. PCT/KR2021/016259 filed Nov. 9, 2021, claiming priority based on Korean Patent Application No. 10-2020-0149591 filed Nov. 10, 2020.

TECHNICAL FIELD

Embodiments relate to an aerosol generating article and an aerosol generating system including the same, and more particularly, to an aerosol generating article impregnated with different liquid compositions, and an aerosol generating system including the aerosol generating article.

BACKGROUND ART

Recently, the demand for alternative methods to overcome the disadvantages of traditional cigarettes has increased. For example, there is growing demand for an aerosol generating device which generates aerosol by heating an aerosol generating material in cigarettes, rather than by combusting cigarettes. Accordingly, researches on a heating-type cigarette or a heating-type aerosol generating device have been actively conducted.

In addition, the demand for an aerosol generating device generating aerosol by heating a liquid aerosol generating material has increased. This type of aerosol generating device stores a liquid composition, and when the user wants to inhale, the stored liquid composition is vaporized to generate an aerosol.

However, when using the aerosol generating device storing a liquid composition as described above, when the liquid composition is used up, an inconvenience occurs in that liquid composition needs to be additionally injected into the device or a new device must be purchased. Accordingly, there is a need for research on an aerosol generating article that can generate an aerosol by using a liquid composition for providing various flavors to a user, and can be conveniently reused.

DESCRIPTION OF EMBODIMENTS

Technical Problem

Embodiments provide an aerosol generating article impregnated with a liquid composition and an aerosol generating system including the aerosol generating device.

The objective to be solved by the present disclosure is not limited to the objectives described above, and objectives that are not mentioned above will be clearly understood by those of ordinary skill in the art from the present specification and the accompanying drawings.

Solution to Problem

According to an embodiment, an aerosol generating article includes: a first segment impregnated with a first liquid composition; a second segment impregnated with a second liquid composition that is different from the first liquid composition; a cooling portion configured to allow an aerosol generated in the first segment or the second segment, to pass therethrough and cool the aerosol; and a filter portion having a hollow through which the aerosol that passed through the cooling portion flows.

According to another embodiment, an aerosol generating system includes: an aerosol generating article according to the embodiments; and an aerosol generating device including a receiving space for receiving the aerosol generating article and a heater configured to heat the aerosol generating article.

Advantageous Effects of Disclosure

An aerosol generating article according to embodiments is impregnated with different liquid compositions to provide a user with aerosol having various flavors, and allows the user to comfortably use an aerosol generating device without worrying about leakage of the liquid compositions.

In addition, the aerosol generating article according to the embodiments may include various types of hollows, thereby providing inhalation resistance to provide a user with a feeling of satisfaction in smoking.

In addition, the user may conveniently prepare for the next aerosol inhalation by removably receiving the aerosol generating article in the aerosol generating device and removing the aerosol generating article after use.

The effects according to the embodiments are not limited to the above-described effects, and the effects not mentioned herein will be clearly understood by those of ordinary skill in the art, to which the embodiments pertain, from the present specification and the accompanying drawings.

MODE OF DISCLOSURE

Figure 1:
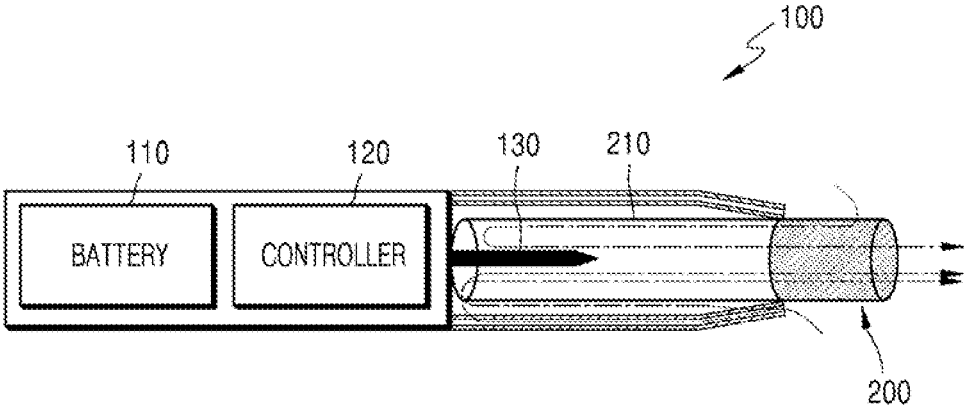
FIG. 1 is a diagram showing an example in which a cigarette is inserted into an aerosol generating device.

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Meanwhile, the terminology used herein is for the purpose of describing embodiments only and is not intended to limit the embodiments. As used herein, the singular forms "a," "an" and "the" are intended to include the plural forms as well, unless the context clearly indicates otherwise.

It will be understood that, although the terms such as 'first,' 'second,' etc. may be used herein to describe various elements, these elements should not be limited by these terms. These terms are only used to distinguish one element from another.

Throughout the specification, the "length direction" of an element may be a direction in which the element extends along an axis in one direction of the element, wherein the axis in one direction of the element may refer to a direction in which the element extends longer than along the other axis that crosses the one axis.

Throughout the specification, an 'embodiment' denotes arbitrary division for easily describing the present disclosure, and each of the embodiments is not necessarily mutually exclusive. For example, configurations disclosed in an embodiment may be applied and implemented in other embodiments, and in this case, changes thereto may be applied and implemented without departing from the scope of the present specification.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a diagram showing an example in which a cigarette is inserted into an aerosol generating device.

Referring to FIG. 1, the aerosol generating device 100 may include a battery 110, a controller 120, and a heater 130. Also, the cigarette 200 may be inserted into an inner space of the aerosol generating device 100.

FIG. 1 illustrates components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIG. 1.

FIG. 1 illustrates that the battery 110, the controller 120, and the heating element 130 are arranged in series, but the arrangement of these are not limited thereto. In other words, according to the design of the aerosol generating device 100, the battery 110, the controller 120, and the heating element 130 may be differently arranged.

When the cigarette 200 is inserted into the aerosol generating device 100, the aerosol generating device 100 heats the heating element 130. The temperature of an aerosol generating material in the cigarette 200 is raised by the heated heating element 130, and thus the aerosol is generated. The generated aerosol is delivered to a user through a filter 220 of the cigarette 200.

As necessary, even when the cigarette 200 is not inserted into the aerosol generating device 100, the aerosol generating device 100 may heat the heating element 130.

The battery 110 may supply power to be used for the aerosol generating device 100 to operate. For example, the battery 110 may supply power to heat the heating element 130, and may supply power for operating the controller 120. Also, the battery 110 may supply power for operations of a display, a sensor, a motor, etc. mounted in the aerosol generating device 100.

The controller 120 may generally control operations of the aerosol generating device 100. In detail, the controller 120 may control not only operations of the battery 110 and the heating element 130, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heating element 130 may be heated by power supplied from the battery 110. For example, when the cigarette is inserted into the aerosol generating device 100, the heating element 130 may be located inside the cigarette. Thus, the heated heating element 130 may increase a temperature of an aerosol generating material in the cigarette.

The heating element 130 may include an electro-resistive heating element. For example, the heating element 130 may include an electrically conductive track, and the heating element 130 may be heated when currents flow through the electrically conductive track. However, the heating element 130 is not limited to the example described above and may include all heating elements which may be heated to a desired temperature. Here, the desired temperature may be pre-set in the aerosol generating device 100 or may be set by a user.

As another example, the heating element 130 may include an induction heating element. In detail, the heating element 130 may include an electrically conductive coil for heating a cigarette in an induction heating method, and the cigarette may include a susceptor which may be heated by the induction heating element.

FIG. 1 illustrates that the heating element 130 is inserted into the cigarette 200, but it is not limited thereto. For example, the heating element 130 may include a tube-type heating element, a plate-type heating element, a needle-type heating element, or a rod-type heating element, and may heat the inside or the outside of the cigarette 200, according to the shape of the heating element.

Also, the aerosol generating device 100 may include a plurality of heating elements 130. Here, the plurality of heating elements 130 may be inserted into the cigarette 200 or may be arranged outside the cigarette 200.

Also, some of the plurality of heating elements 130 may be inserted into the cigarette 200, and the others may be arranged outside the cigarette 200. In addition, the shape of the heating element 130 is not limited to the shape illustrated in FIG. 1, and may include various shapes.

The aerosol generating device 100 may further include general-purpose components in addition to the battery 110, the controller 120, and the heating element 130. For example, the aerosol generating device 100 may include a display capable of outputting visual information and/or a motor for outputting haptic information. Also, the aerosol generating device 100 may include at least one sensor (a puff detecting sensor, a temperature detecting sensor, a cigarette insertion detecting sensor, etc.).

Also, the aerosol generating device 100 may be formed as a structure that, even when the cigarette 200 is inserted into the aerosol generating device 100, may introduce external air or discharge internal air.

Although not illustrated in FIG. 1, the aerosol generating device 100 and an additional cradle may form together a system. For example, the cradle may be used to charge the battery 110 of the aerosol generating device 100. Alternatively, the heating element 130 may be heated when the cradle and the aerosol generating device 100 are coupled to each other.

The cigarette 200 may be similar to a general combustive cigarette. For example, the cigarette 200 may be divided into a first portion 210 including an aerosol generating material and a second portion 220 including a filter or the like. Alternatively, the second portion 220 of the cigarette 200 may also include an aerosol generating material. For example, an aerosol generating material made in the form of granules or capsules may be inserted into the second portion 220.

The first portion 210 may be completely inserted into the aerosol generating device 100, and the second portion 220 may be exposed to the outside. Alternatively, only a portion of the first portion 210 may be inserted into the aerosol generating device 100, or a portion of the first portion 210 and a portion of the second portion 220 may be inserted thereinto. The user may puff aerosol while holding the second portion 220 by the mouth of the user. In this case, the aerosol is generated by the external air passing through the first portion 210, and the generated aerosol passes through the second portion 220 and is delivered to the user's mouth.

For example, the external air may flow into at least one air passage formed in the aerosol generating device 100. For example, opening and closing of the air passage and/or a size of the air passage formed in the aerosol generating device 100 may be adjusted by the user. Accordingly, the amount and the quality of smoking may be adjusted by the user. As another example, the external air may flow into the cigarette 200 through at least one hole formed in a surface of the cigarette 200.

Hereinafter, an example of the cigarette 200 will be described with reference to FIG. 2.

Figure 2:
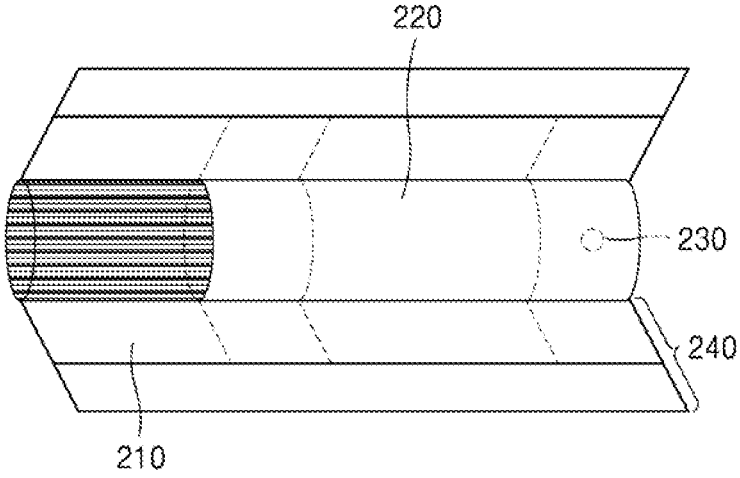
FIG. 2 shows a view showing an example of the cigarette.

FIG. 2 shows a view showing an example of the cigarette.

Referring to FIG. 2, the cigarette 200 includes a tobacco rod 210 and a filter rod 220. The first portion described above with reference to FIG. 1 includes the tobacco rod 210, and the second portion includes the filter rod 220.

FIG. 2 illustrates that the filter rod 220 includes a single segment, but is not limited thereto. In other words, the filter rod 220 may include a plurality of segments.

For example, the filter rod 220 may include a first segment configured to cool an aerosol and a second segment configured to filter a certain component included in the aerosol. Also, as necessary, the filter rod 220 may further include at least one segment configured to perform other functions.

The cigarette 200 may be packaged by at least one wrapper 240. The wrapper 240 may have at least one hole through which external air may be introduced or internal air may be discharged. For example, the cigarette 200 may be packaged by one wrapper 240. As another example, the cigarette 200 may be doubly packaged by two or more wrappers 240. For example, the tobacco rod 210 may be packaged by a first wrapper, and the filter rod 220 may be packaged by a second wrapper. Also, the tobacco rod 210 and the filter rod 220, which are respectively packaged by separate wrappers, may be coupled to each other, and the entire cigarette 200 may be packaged by a third wrapper. When each of the tobacco rod 210 or the filter rod 220 is composed of a plurality of segments, each segment may be packaged by separate wrappers. Also, the entire cigarette 200 including the plurality of segments, which are respectively packaged by the separate wrappers and which are coupled to each other, may be re-packaged by another wrapper.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand.

Also, the tobacco rod 210 may be formed as a pipe tobacco, which is formed of tiny bits cut from a tobacco sheet.

Also, the tobacco rod 210 may be surrounded by a heat conductive material. For example, the heat conductive material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heating element. Here, although not illustrated in the drawings, the tobacco rod 210 may further include an additional susceptor, in addition to the heat conductive material surrounding the tobacco rod 210.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may perform a function of generating a flavor or an aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Figure 3:
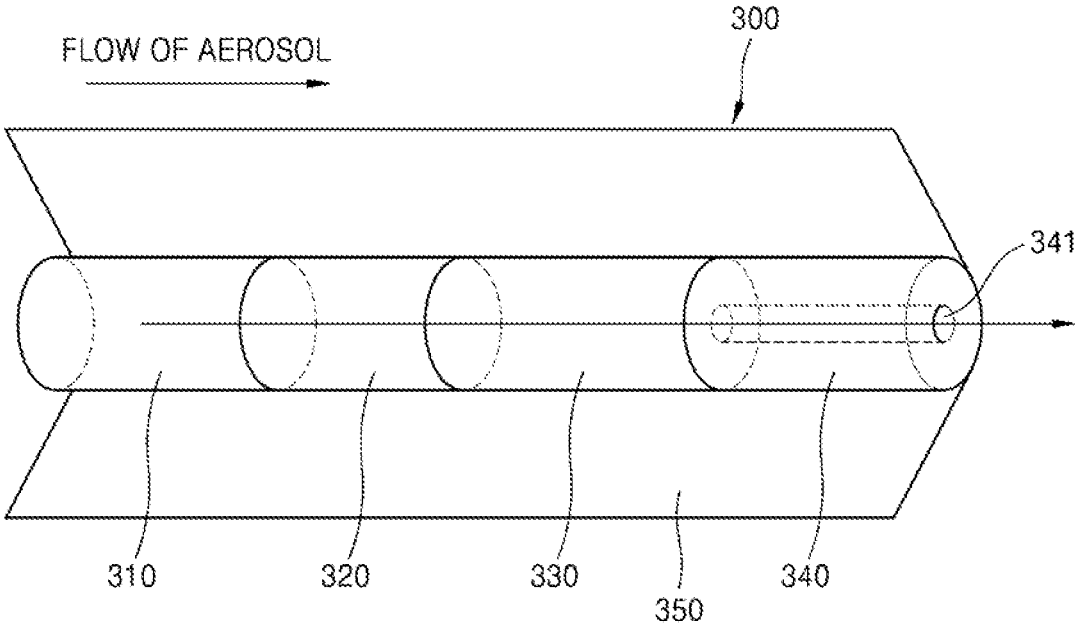
FIG. 3 shows an aerosol generating article according to an embodiment.

FIG. 3 shows an aerosol generating article 300 according to an embodiment.

Referring to FIG. 3, the aerosol generating article according to an embodiment may include a first segment 310, a second segment 320, a cooling portion 330, a filter portion 340, and a wrapper 350.

The first segment 310 may be impregnated with a first liquid composition. When the first liquid composition of the first segment 310 is heated, aerosol may be generated.

The first liquid composition may include a tobacco extract. A tobacco extract may include a naturally generated pure nicotine or synthetic nicotine and may have any suitable weight concentration relative to the total solution weight of the first liquid composition. For example, a tobacco extract may include, but is not limited to, freebase nicotine or nicotine-salt.

The first liquid composition may include two or more types of nicotine salts. Nicotine salts may be formed by adding, to nicotine, suitable acids, including organic or inorganic acids. Acid for the formation of the nicotine salts may be appropriately selected in consideration of the rate of nicotine absorption in the blood, the temperature at which the aerosol generating article 300 is heated, the flavor or taste, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

For example, the first liquid composition may include one component of water, solvents, ethanol, plant extracts, spices, flavorings, and vitamin mixtures, or a mixture of these components. The spices may include, but is not limited to, menthol, peppermint, spearmint oil, and various fruit flavoring ingredients. The flavorings may include ingredients capable of providing various flavors or tastes to a user. Vitamin mixtures may be a mixture of at least one of vitamin A, vitamin B, vitamin C, and vitamin E, but are not limited thereto.

In addition, the first liquid composition may include a moisturizing agent. Moisturizing agents may act as aerosol formers that are heated to provide a rich amount of smoke. For example, the moisturizing agent may be, but is not limited to, glycerin and propylene glycol or a mixture thereof.

The second segment 320 may be arranged on one side of the first segment 310 to allow the aerosol generated in the first segment 310 to pass therethrough. The second segment 320 may be impregnated with a second liquid composition that is different from the first liquid composition. When the second liquid composition of the second segment 320 is heated, aerosol may be generated.

The second liquid composition and the first liquid composition may include substantially the same components as each other, but may be distinguished from each other according to whether or not nicotine, which is a tobacco extract, is included. For example, the first liquid composition may include either a tobacco extract or a moisturizing agent, and the second liquid composition may include a tobacco extract or a moisturizing agent other than the materials included in the first liquid composition.

The spices included in the second liquid composition may cooperate with the spices included in the first liquid composition to provide a combined taste to the user. For example, each of aerosols generated from the spices included in the first liquid composition or the second liquid composition may be combined with each other to provide a new taste to the user or serve as a enhancer for enhancing either flavor.

As an example, the first liquid composition may include nicotine, and the second liquid composition may include a moisturizing agent other than the nicotine. Accordingly, in the first segment 310, aerosol containing nicotine that satisfies the user's smoking desire may be generated, and in the second segment 320, aerosol having a rich amount of smoke may be generated from the moisturizing agent.

The cooling portion 330 may cool the aerosol generated in the first segment 310 or the second segment 320 while allowing the aerosol to pass therethrough. The cooling portion 330 may be arranged at one side of the second segment 320 to be connected to the second segment 320.

The cooling portion 330 may include, for example, polylactic acid or cellulose acetate as a material. However, the material of the cooling portion 330 is not limited to the above, and a material capable of performing a function of cooling aerosol may be used without limitation. For example, the cooling portion 330 may be a tube filter or a branch tube including a hollow.

The filter portion 340 may be arranged at one side of the cooling portion 330 to allow the aerosol that passed through the cooling portion 330, to pass therethrough and filter the aerosol. In addition, the filter portion 340 may allow the aerosol that passed through the cooling portion 330, to pass through and cool the aerosol. For example, the material of the filter portion 340 may be cellulose acetate, but is not limited thereto.

The filter portion 340 may be manufactured to generate a flavor. As an example, a flavoring liquid may be injected into the filter portion 340, and a separate fiber to which a flavoring liquid is applied may be inserted into the filter portion 340.

In addition, at least one capsule may be included in the filter portion 340. Here, the capsule may have a function of generating a flavor or aerosol. In this case, spices included in the capsule may provide various tastes to a user in cooperation with aerosol generated in the first segment 310 or the second segment 320. For example, the capsule may have a configuration in which a liquid containing spices is wrapped with a film. For example, the capsule may have a spherical or cylindrical shape, but is not limited thereto.

A hollow 341 may be formed in the filter portion 340. Aerosol that passed through the cooling portion 330 may flow inside the hollow 341, and the aerosol may be cooled by passing through the hollow 341.

For example, the hollow 341 may extend from one end of the cooling portion 330 in a length direction of the aerosol generating article 300 to pass through the filter portion 340.

In the aerosol generating article 300 including a tobacco material in a solid form, the filtering ability of the filter portion 340 may be important in order to filter particulates that may be generated as the tobacco material in a solid form is heated. In the aerosol generating article 300 impregnated with a liquid composition in a liquid form, the need for the filtering ability of the filter portion 340 may be halved.

Accordingly, as the aerosol generating article 300 according to an embodiment includes the hollow 341 in the filter portion 340, the aerosol generated in the first segment 310 or the second segment 320 may be smoothly cooled, and the flavor of the aerosol may be intuitively delivered to the user. In addition, since the inhalation resistance of the aerosol generating article 300 is reduced as the hollow 341 is included, the aerosol generating article 300 may provide a user with a soft feeling of inhalation.

While it is shown in FIG. 3 that aerosol passes only through the hollow 341, the aerosol that passed through the cooling portion 330 may also pass through other regions of the filter portion 340 except for a region of the filter portion 340, in which the hollow 341 is formed.

The wrapper 350 may surround the aerosol generating article 300, thereby forming the exterior surface of the aerosol generating article 300. For example, the aerosol generating article 300 including one wrapper 350 is illustrated in FIG. 3, but the present disclosure is not limited thereto, and a plurality of wrappers 350 may respectively surround the first segment 310, the second segment 320, the cooling portion 330, and the filter portion 340.

Figure 4:
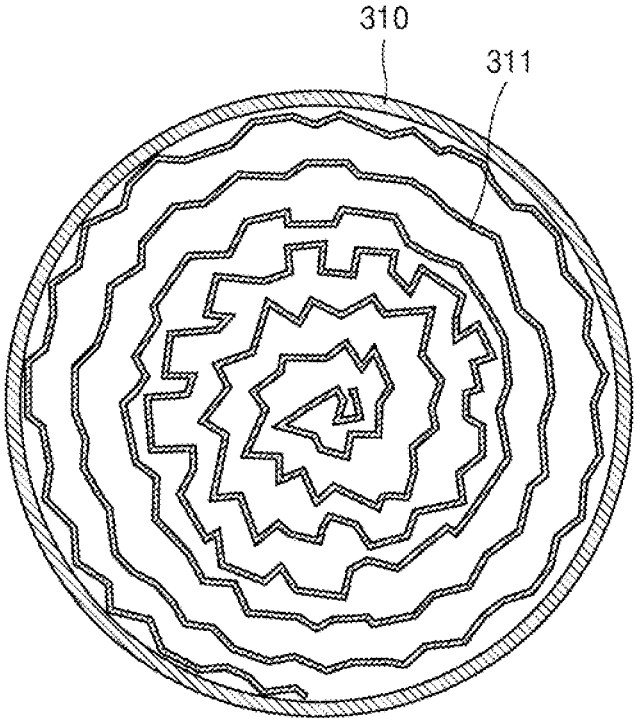
FIG. 4 is a cross-sectional view of a first segment of the aerosol generating article illustrated in FIG. 3.
Figure 5:
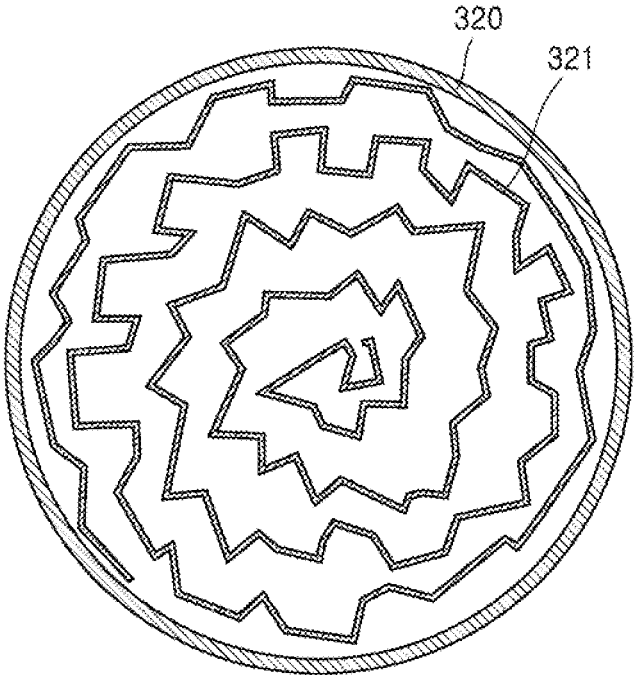
FIG. 5 is a cross-sectional view of a second segment of the aerosol generating article illustrated in FIG. 3.

FIG. 4 is a cross-sectional view of the first segment 310 of the aerosol generating article 300 illustrated in FIG. 3, and FIG. 5 is a cross-sectional view of the second segment 320 of the aerosol generating article 300 illustrated in FIG. 3.

Referring to FIG. 4, a crimped sheet 311 may be filled in the first segment 310. The sheet 311 may be a polymer material or a cellulose material capable of absorbing an aerosol generating material. For example, the sheet 311 may be a paper sheet that does not generate off-flavor due to heat even when heated to a high temperature, but is not limited thereto.

The sheet 311 may be in a crimped form. Here, the crimped form refers to a form in which the sheet 311 is processed into a wrinkled form and includes one or more curves. The crimping of the sheet 311 may be performed by at least one of a crimping process, a pleating process, and a gathering process, but is not limited thereto.

As the sheet 311 is impregnated with the first liquid composition, the first segment 310 may retain the first liquid composition. For example, the first liquid composition may be impregnated into the first segment 310 in the form in which the first liquid composition is absorbed onto a surface of the sheet 311 or absorbed into the sheet 311.

Referring to FIG. 5, a crimped sheet 321 may be filled in the second segment 320. The second segment 320 may be filled with the crimped sheet 321 in substantially the same form as the first segment 310, but may have a different filling density from the first segment 310.

The filling density may refer to a volume or mass take by the sheets 311 and 321 in a space defined by the first segment 310 or the second segment 320. That is, the higher the filling density, it may indicate that the amount of the sheet 311 or 321 filled in the first segment 310 or the second segment 320 increases.

The filling density of the sheet 311 filled in the first segment 310 and the filling density of the sheet 321 filled in the second segment 320 may be different from each other. For example, the filling density of the sheet 311 filled in the first segment 310 may be higher than the filling density of the sheet 321 filled in the second segment 320. Accordingly, the inhalation resistance of the first segment 310 may be higher than the inhalation resistance of the second segment 320, and the amount of the first liquid composition impregnated in the first segment 310 may be greater than the amount of the second liquid composition impregnated in the second segment 320.

While FIGS. 4 and 5 illustrate the first segment 310 and the second segment 320 having a form in which one crimped sheet is rolled, but the present disclosure is not limited thereto, and the first segment 310 or the second segment 320 may have a form in which a plurality of crimped sheets are filled.

The same reference numerals for the elements of the embodiment shown in FIGS. 1 to 5 may refer to substantially the same elements below, and the elements for one embodiment may also be applied to other embodiments in substantially the same manner.

Figure 6:
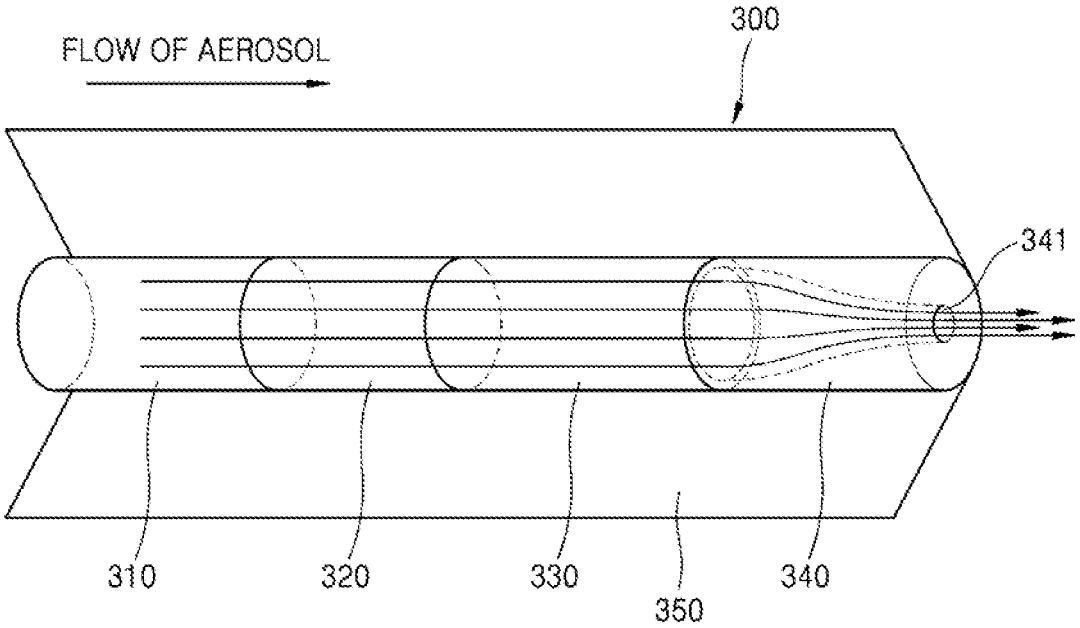
FIG. 6 shows an aerosol generating article according to another embodiment.

FIG. 6 shows an aerosol generating article 300 according to another embodiment.

Referring to FIG. 6, the hollow 341 of the filter portion 340 may extend from one end of the cooling portion 330 in the length direction of the aerosol generating article 300, but the size of the hollow 341 may be varied according to the extension of the hollow 341. Accordingly, the aerosol generating article 300 may have various inhalation resistances according to the changed size of the hollow 341 and thus provide various inhalation feelings to the user.

For example, the size of the hollow 341 may decrease in the length direction of the aerosol generating article 300. When the size of the hollow 341 decreases toward one end of the aerosol generating article 300, aerosol that passed through the cooling portion 330 is concentrated at the one end of the aerosol generating article 300 and discharged to the outside, and accordingly, the user may experience a strong taste.

Figure 7:
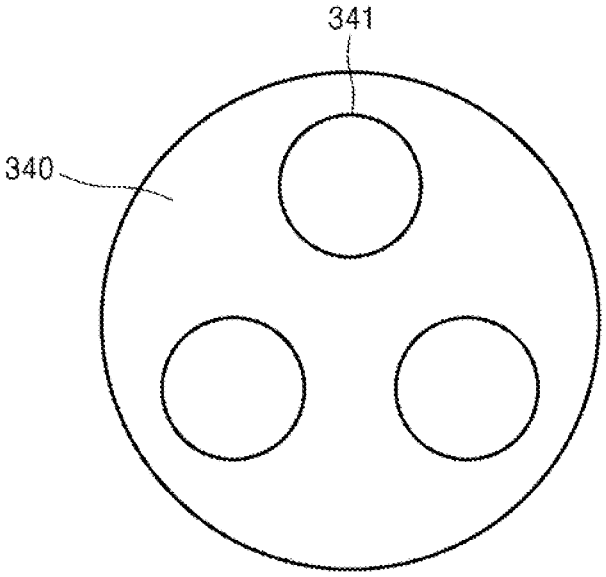
FIG. 7 is a cross-sectional view of an aerosol generating article according to another embodiment.

FIG. 7 is a cross-sectional view of the filter portion 340 of the aerosol generating article 300, according to another embodiment.

Referring to FIG. 7, the filter portion 340 of the aerosol generating article 300 according to another embodiment may include a plurality of hollows 341. In addition, the plurality of hollows 341 may be arranged apart from each other.

As the aerosol generating article according to another embodiment includes a plurality of hollows 341 through which the aerosol passes, aerosol generated in a first segment (not shown) and a second segment (not shown) may be cooled, and also, the flavor of the aerosol may be delivered to the user more intuitively.

In addition, as the inhalation resistance of the aerosol generating article is reduced when the hollows 341 are included, the aerosol generating article according to another embodiment may include the plurality of hollows 341 to provide a softer inhalation feeling to the user.

Figure 8:
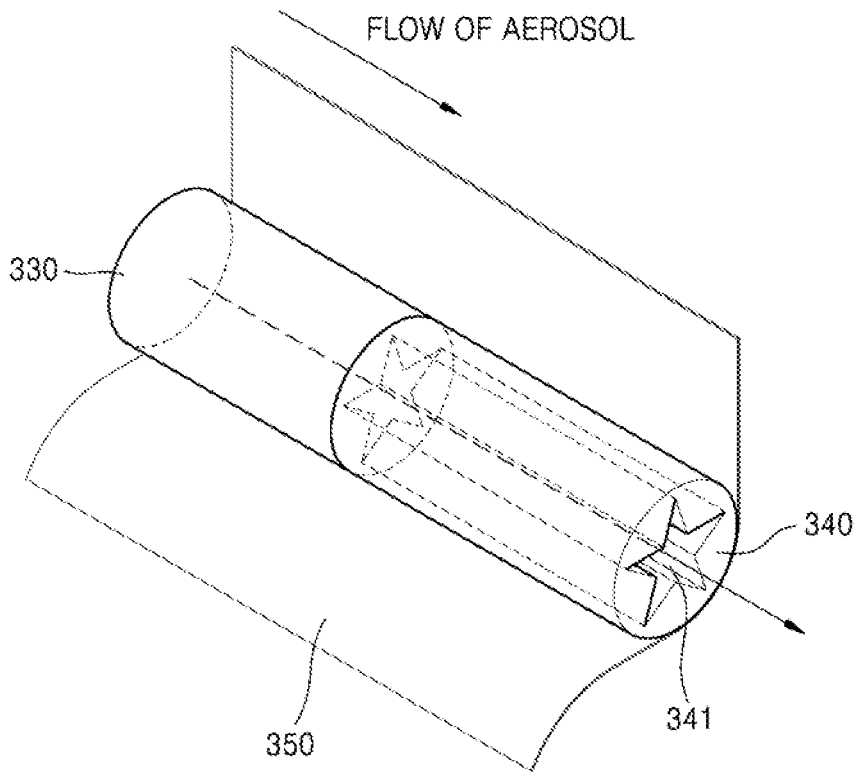
FIG. 8 shows a cooling portion and a filter portion of an aerosol generating article, according to another embodiment.

FIG. 8 shows a cooling portion 330 and a filter portion 340 of an aerosol generating article according to another embodiment.

Referring to FIG. 8, a hollow 341 of the filter portion 340 may extend in a length direction of the aerosol generating article as well as in a radial direction. Also, the hollow 341 may extend in the radial direction, and a size of the hollow 341 may decrease in the radial direction.

Accordingly, the aerosol generating article 300 may have various inhalation resistances according to the varying size of the hollow 341, thereby providing various inhalation feelings to the user.

The hollow 341 having a partially bent cross-section is illustrated in FIG. 8, but is not limited thereto, and the hollow 341 may have a partially curved cross-section.

Figure 9:
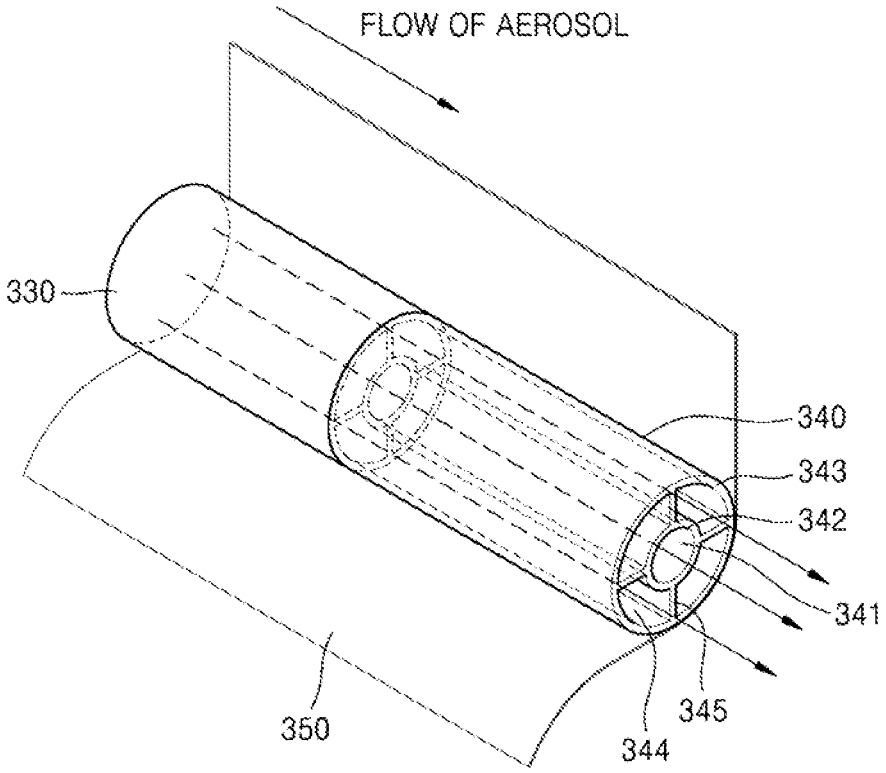
FIG. 9 shows a cooling portion and a filter portion of an aerosol generating article, according to another embodiment.

FIG. 9 shows a cooling portion 330 and a filter portion 330 of an aerosol generating article 300 according to another embodiment.

Referring to FIG. 9, the filter portion 340 may include a first filter portion 342 and a second filter portion 343.

The first filter portion 342 may include a hollow 341. The second filter portion 343 may be arranged apart from the first filter portion 342 to surround the first filter portion 342. For example, the first filter portion 342 in which the hollow 341 is formed may be arranged at a center of the filter portion 340, and the second filter portion 343 may be arranged apart from the first filter portion 342 and on the outside of the first filter portion 342 to surround the first filter portion 342.

A discharge passage 344 is a passage through which aerosol that passed through the cooling portion 330 is discharged to the outside. The discharge passage 344 may refer to a space between the first filter portion 342 and the second filter portion 343, the space being formed as the first filter portion 342 and the second filter portion 343 are spaced apart from each other.

For example, the first filter portion 342 including the hollow 341 may be arranged at a center of the filter portion 340, and the discharge passage 344 may be arranged outside the first filter portion 342 to surround the first filter portion 342, and the second filter portion 343 may be arranged to surround the discharge passage 344 outside the discharge passage 344.

A protrusion 345 may divide the discharge passage 344 into a plurality of spaces. The protrusion 345 may protrude from the first filter portion 342 toward the second filter portion 343 that is outside the first filter portion 342. Accordingly, the hollow 341 may be arranged in a form the hollow 341 is surrounded by the discharge passage 344 divided into a plurality of spaces.

The protrusion 345 may connect the first filter portion 342 having the hollow 341 formed therein to the second filter portion 343 and thus support the first filter portion 342 to prevent the first filter portion 342 from being separated to the outside of the aerosol generating article.

As described above, as the aerosol generating article according to another embodiment includes the hollow 341 or the discharge passage 344 for discharging aerosol to the outside, aerosol generated in a first segment (not shown) and a second segment (not shown) may be cooled, and also, the flavor of the aerosol may be delivered to the user intuitively, and a smooth inhalation feeling may be provided to the user.

Figure 10:
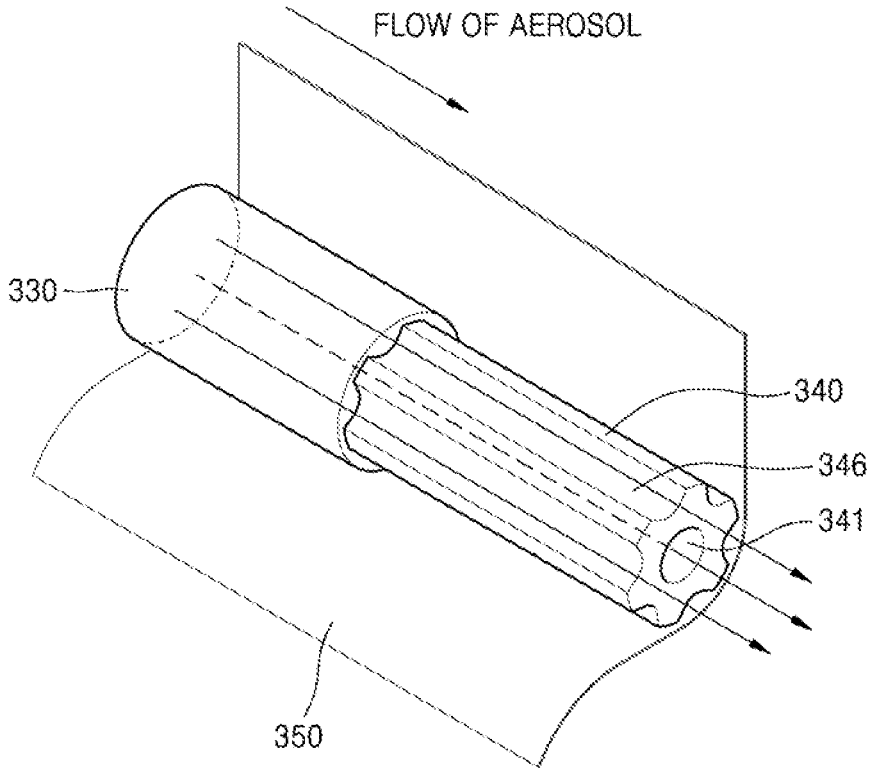
FIG. 10 shows a cooling portion and a filter portion of an aerosol generating article, according to another embodiment.

FIG. 10 shows a cooling portion 330 and a filter portion 340 of an aerosol generating article, according to another embodiment.

Referring to FIG. 10, at least a portion of an outer surface of the filter portion 340 of the aerosol generating article according to another embodiment may be depressed in a direction toward the hollow 341. For example, as a portion of the outer surface of the filter portion 340 is depressed in a direction toward the hollow 341, the filter portion 340 may have a shape including irregularities.

An airflow passage 346 is a passage through which aerosol that passed through the cooling portion 330 is discharged to the outside. The airflow passage 346 may refer to a space formed between the wrapper 350 and the filter portion 340 as at least a portion of the outer surface of the filter portion 340 is depressed. Accordingly, the aerosol passing through the cooling portion 330 may pass through the airflow passage 346 arranged between the wrapper 350 and the filter portion 340 to be discharged to the outside of the aerosol generating article.

As described above, as the aerosol generating article according to another embodiment includes the hollow 341 or the airflow passage 346 for discharging aerosol to the outside, aerosol generated in a first segment (not shown) and a second segment (not shown) may be cooled, and also, the flavor of the aerosol may be delivered to the user intuitively, and a smooth inhalation feeling may be provided to the user.

Figure 11:
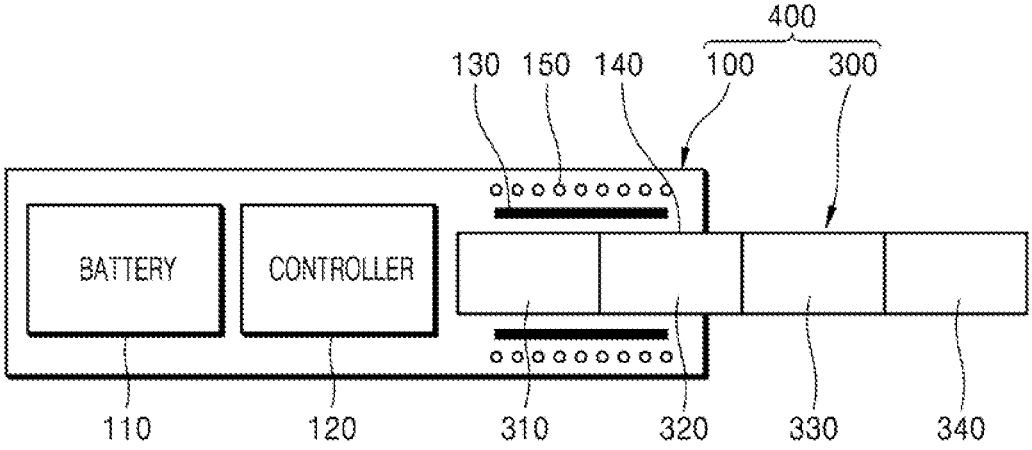
FIG. 11 shows an aerosol generating system according to another embodiment.

FIG. 11 shows an aerosol generating system 400 according to another embodiment.

Referring to FIG. 11, the aerosol generating system 400 according to another embodiment may include the aerosol generating article 300 according to the above-described embodiments and an aerosol generating device 100.

The aerosol generating device 100 may include a battery 110, a controller 120, a heater 130, a receiving space 140, and an induction coil 150. The battery 110, the controller 120, and the heater 130 may be substantially the same as the battery 110, the controller 120 and the heater 130 of FIG. 1. Accordingly, description of repeated details is omitted.

The receiving space 140 may receive the aerosol generating article 300. The aerosol generating article 300 may be inserted into the receiving space 140 and then removed from the receiving space 140 after use.

The induction coil 150 may be an electrically conductive coil that generates an alternating current magnetic field by power supplied from the battery 110. The induction coil 150 may be arranged to surround at least a portion of the receiving space 140, and may apply an alternating current magnetic field to the heater 130.

The heater 130 may include a susceptor heated by an alternating current magnetic field applied by the induction coil 150.

For example, the susceptor may include at least one selected from ferrite, a ferromagnetic alloy, stainless steel, and aluminum, or a combination thereof.

In addition, the susceptor may include at least one of graphite, molybdenum, silicon carbide, niobium, a nickel alloy, a metal film, ceramic such as zirconia, a transition metal such as (Ni) or cobalt (Co), and a metalloid such as boron (B) or phosphorus (P), or a combination thereof. However, the susceptor is not limited to the above-described examples, and as long as it can be heated to a desired temperature as an alternating current magnetic field is applied thereto, the susceptor may be applied without limitation.

The heater 130 may surround the first segment 310 and the second segment 320 once the aerosol generating article 300 is inserted into the receiving space 140. When an alternating current magnetic field is applied to the heater 130 by the induction coil 150, the heater 130 may generate heat and heat at least a portion of the first segment 310 or the second segment 320 of the aerosol generating article 300. Accordingly, aerosol is generated from the first liquid composition of the first segment 310 and the second liquid composition of the second segment 320, and the generated aerosol may pass through the cooling portion 330 and the filter portion 340 and be delivered to the user.

When the consumption rate of the first liquid composition impregnated in the first segment 310 or the second liquid composition impregnated in the second segment 320 is excessively fast, the aerosol generating system 400 may not provide aerosol having a uniform atomization amount or taste, to the user. Accordingly, the heater 130 of the aerosol generating system 400 may heat only a portion of the aerosol generating article 300 to control the amount of aerosol generated in the first segment 310 and the second segment 320.

As an example, a length of the heater 130 may be shorter than a sum of a length of the first segment 310 and a length of the second segment 320. In this case, a portion of the first segment 310 or the second segment 320 may not be directly heated by the heater 130. Accordingly, a rate at which the first liquid composition or the second liquid composition is consumed in the first segment 310 or the second segment 320 may be adjusted.

As another example, within the receiving space 140, the heater 130 may move in a direction toward the first segment 310 or toward the second segment 320 with respect to the length direction of the aerosol generating article 300. As the heater 130 moves, a portion of the first segment 310 or the second segment 320, the portion being heated by the heater 130, may be varied over time. Accordingly, the rate at which the first liquid composition or the second liquid composition is consumed in the first segment 310 or the second segment 320 may be adjusted.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating article comprising:

a first segment impregnated with a first liquid composition;

a second segment impregnated with a second liquid composition that is different from the first liquid composition;

a cooling portion configured to allow an aerosol generated in the first segment or the second segment to pass therethrough and cool the aerosol;

a filter portion having two or more hollows through which the aerosol that passed through the cooling portion flows the two or more hollows extending from one end of the cooling portion in a length direction of the aerosol generating article and passing through the filter portion; and a wrapper at least partially surrounding an outer surface of the filter portion, wherein the filter portion comprises a first filter portion in which one hollow is formed, a second filter portion that is apart from the first filter portion and in contact with the wrapper and at least partially surrounds the first filter portion and a protrusion that protrudes from the first filter portion in a direction toward the second filter portion, and wherein, based on the first filter portion and the second filter portion being arranged apart from each other, one or more hollows are formed between the first filter portion and the second filter portion.

2. The aerosol generating article of claim 1, wherein the first liquid composition comprises one of a tobacco extract or a moisturizing agent, and the second liquid composition comprises the other one of the tobacco extract or the moisturizing agent of the first liquid composition.

3. The aerosol generating article of claim 2, wherein the tobacco extract comprises freebase nicotine or nicotine salt.

4. The aerosol generating article of claim 1, wherein a crimped sheet is filled in each of the first segment and the second segment.

5. The aerosol generating article of claim 4, wherein a filling density of the crimped sheet filled in the first segment is different from a filling density of the crimped sheet filled in the second segment.

6. The aerosol generating article of claim 1, wherein a size of the two or more hollows decreases in the length direction of the aerosol generating article.

7. The aerosol generating article of claim 1, wherein the two or more hollows extend in a radial direction, and a size of the two or more hollows decreases in the radial direction.

8. An aerosol generating system comprising:

an aerosol generating article according to claim 1; and an aerosol generating device including a receiving space for receiving the aerosol generating article and a heater configured to heat the aerosol generating article.

9. The aerosol generating system of claim 8, wherein the heater surrounds the first segment and the second segment when the aerosol generating article is inserted into the aerosol generating device.

10. The aerosol generating system of claim 8, wherein a length of the heater is less than a sum of a length of the first segment and a length of the second segment.

* * * * *